US009031450B2

(12) United States Patent
Sakuma et al.

(10) Patent No.: US 9,031,450 B2
(45) Date of Patent: May 12, 2015

(54) TONER COLLECTION UNIT AND IMAGE FORMING APPARATUS INCORPORATING SAME

(71) Applicants: Tetsushi Sakuma, Osaka (JP); Takeshi Sakashita, Hyogo (JP); Kenji Nakamura, Osaka (JP); Masanari Fujita, Osaka (JP); Yuuji Meguro, Hyogo (JP); Mitsutoshi Kichise, Osaka (JP)

(72) Inventors: Tetsushi Sakuma, Osaka (JP); Takeshi Sakashita, Hyogo (JP); Kenji Nakamura, Osaka (JP); Masanari Fujita, Osaka (JP); Yuuji Meguro, Hyogo (JP); Mitsutoshi Kichise, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/086,303

(22) Filed: Nov. 21, 2013

(65) Prior Publication Data

US 2014/0147165 A1 May 29, 2014

(30) Foreign Application Priority Data

Nov. 28, 2012 (JP) ..... 2012-259979

(51) Int. Cl.
*G03G 15/08* (2006.01)
*G03G 21/12* (2006.01)

(52) U.S. Cl.
CPC ..... *G03G 21/12* (2013.01)

(58) Field of Classification Search
CPC ..... G03G 21/0011; G03G 21/007; G03G 15/0817; G03G 2221/1648
USPC ..... 399/102, 103, 98, 35, 120
See application file for complete search history.

(56) References Cited

U.S. PATENT DOCUMENTS

| | | | | |
|---|---|---|---|---|
| 2006/0039710 | A1* | 2/2006 | Tawada | 399/35 |
| 2007/0110458 | A1 | 5/2007 | Inoue et al. | |
| 2007/0137418 | A1* | 6/2007 | Smith | 74/560 |
| 2007/0183816 | A1 | 8/2007 | Hatayama et al. | |
| 2007/0269233 | A1 | 11/2007 | Sakashita et al. | |
| 2008/0003022 | A1 | 1/2008 | Sakashita et al. | |
| 2008/0028967 | A1 | 2/2008 | Sakashita et al. | |
| 2008/0050158 | A1 | 2/2008 | Hatayama et al. | |
| 2008/0138133 | A1 | 6/2008 | Hatayama et al. | |
| 2008/0187365 | A1 | 8/2008 | Sakashita et al. | |
| 2008/0193167 | A1 | 8/2008 | Inoue et al. | |
| 2008/0193173 | A1 | 8/2008 | Meguro et al. | |
| 2008/0226358 | A1 | 9/2008 | Hanashima et al. | |
| 2008/0310893 | A1 | 12/2008 | Adachi et al. | |
| 2008/0317521 | A1 | 12/2008 | Inoue et al. | |

(Continued)

FOREIGN PATENT DOCUMENTS

JP 2009-199005 9/2009

*Primary Examiner* — Roy Y Yi

(74) *Attorney, Agent, or Firm* — Oblon, McClelland, Maier & Neustadt, L.L.P.

(57) ABSTRACT

A toner collection unit, which can be included in an image forming apparatus, includes a collected toner container having an opening and storing collected toner, a flexible seal sealing the opening of the collected toner container, having a shape of a recess in an initial condition before toner is collected in the container, and being flexible to change the shape to inflate outwardly due to a pressing force exerted from the toner stored in the container, a moving unit disposed outside the flexible seal and movable both in a positive direction to approach the opening of the container and in an opposite direction to move away from the opening when contacting the flexible seal inflating outwardly, a detector detecting movement of the moving unit, and a regulator regulating the moving unit from coming into the recess of the flexible seal in the initial condition.

20 Claims, 8 Drawing Sheets

(56) References Cited

U.S. PATENT DOCUMENTS

| | | | | |
|---|---|---|---|---|
| 2009/0011882 | A1 | 1/2009 | Kichise et al. | |
| 2009/0014288 | A1 | 1/2009 | Miyazaki et al. | |
| 2009/0016772 | A1 | 1/2009 | Adachi et al. | |
| 2009/0129831 | A1 | 5/2009 | Sakashita et al. | |
| 2009/0232526 | A1* | 9/2009 | Yoneda et al. | 399/30 |
| 2009/0285594 | A1 | 11/2009 | Kichise et al. | |
| 2010/0239334 | A1 | 9/2010 | Iwami et al. | |
| 2011/0274447 | A1* | 11/2011 | Arai et al. | 399/24 |
| 2012/0057908 | A1 | 3/2012 | Meguro | |
| 2012/0114373 | A1 | 5/2012 | Hamada et al. | |
| 2012/0237268 | A1 | 9/2012 | Sakashita et al. | |
| 2013/0011158 | A1 | 1/2013 | Meguro et al. | |
| 2013/0051854 | A1 | 2/2013 | Sakuma et al. | |

* cited by examiner

TONER COLLECTION UNIT AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2012-259979, filed on Nov. 28, 2012 in the Japan Patent Office, the entire disclosure of which is hereby incorporated by reference herein.

BACKGROUND

1. Technical Field

Embodiments of the present invention relate to a toner collection unit that stores toner such as waste toner collected from units and components provided in an image forming apparatus, and an image forming apparatus including the toner collection unit therein.

2. Related Art

In electrophotographic image forming apparatuses, toner is transferred from a photoconductor onto a transfer belt and from the transfer belt onto a recording medium. In performing these toner transfer operations, it is difficult to achieve a perfect or 100% transfer rate, and therefore residual toner remains on the photoconductor and the transfer belt after the toner transfer operations. The residual toner is collected by a cleaner having a suitable configuration for operations in each electrophotographic image forming apparatus and stored as waste toner in a toner collection unit provided in the image forming apparatus. As the amount of waste toner stored in the toner collection unit approaches a full state, a message is issued to report the status of the toner collection unit. In response to the report, a user or a service engineer replaces the toner collection unit to a new unit or disposes the toner collection unit.

As an example of detection that an amount of waste toner of a toner collection unit approaches the toner full state, Japanese Patent Application Publication No. JP 2009-199005-A discloses a configuration in which a flexible seal is provided to a waste toner collection unit in a downwardly warped manner, as illustrated in FIGS. 9 and 10 thereof. When the waste toner collection unit is filled with waste toner, the flexible seal is warped upwardly. This deformation of the flexible seal pushes up a moving member, so that a photointerrupter detects movement of the moving member.

However, even though the flexible seal is deformed due to accumulation of waste toner in the waste toner collection unit, the shape of the flexible seal does not change uniformly over the whole flexible seal. Actually, it is likely that the change of shape of the flexible seal occurs irregularly and unevenly and the flexible seal has locally deformed areas on a surface thereof. Therefore, the locally deformed areas of the flexible seal may be caught at an edge of the moving member or be pried at a support portion of the moving member. Such unevenly changed flexible seal can apply a load to the moving member when the moving member moves. Consequently, the photointerrupter causes a delay in detecting the full state in the waste toner collection unit, which is likely to cause leakage of waste toner.

As disclosed in JP 2009-199005-A, the moving member is disposed in a recessed space of the flexible seal in an initial condition that is a condition before waste toner is collected to the waste toner collection unit. FIG. 1 is an example drawing that illustrates a position of a moving member in the initial condition. As illustrated in FIG. 1, when a flexible seal 330 is warped or bulged out, the flexible seal 330 easily comes into a gap between the moving member 300 and an edge of an opening 320 of a waste toner collection unit 310. Consequently, it is likely that the flexible member 330 twines around the moving member 300. In this case, a load is applied on the moving member 300 when the moving member 300 moves. Therefore, the above-described inconveniences become obvious.

SUMMARY

The present invention provides a toner collection unit including a collected toner container having an opening and storing collected toner, a flexible seal configured to seal the opening of the collected toner container, having a cross-sectional recess in an initial condition before the toner is collected in the collected toner container, and being flexible to change the shape to inflate outwardly due to a pressing force exerted from the toner stored in the collected toner container, a moving unit disposed outside the flexible seal and movable both in a positive direction to approach the opening of the collected toner container and in an opposite direction to move away from the opening of the collected toner container, and configured to rotate in the opposite direction when contacting the flexible seal inflating outwardly, a detector configured to detect movement of the moving unit, and a regulator configured to regulate the moving unit from coming into the recess of the flexible seal in the initial condition.

Further, the present invention provides an image forming apparatus including an image forming unit configured to form an image, and the above-described toner collection unit.

Further, the present invention provides an image forming apparatus including a collected toner container having an opening, a flexible seal to seal the opening and to include a recessed portion being inflatable outwardly, a contact plate including an extended portion that extends out of the recessed portion, and a detector to detect movement of the contact plate. The extended portion contacts with an adjacent area of the opening when the recessed portion recesses, and the contact plate moves outwardly when the recessed portion inflates outwardly.

Further, the present invention provides an image forming apparatus including a collected toner container having an opening, a flexible seal to seal the opening and to include a recessed portion being inflatable outwardly, a contact plate to contact with the recessed portion and to move by inflation of the recessed portion, and a detector to detect movement of the contact plate. A width of the contact plate is greater than a width of the opening.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
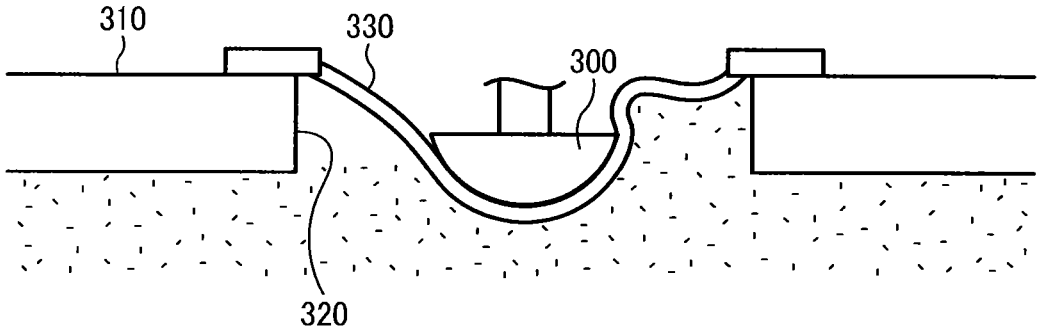
FIG. 1 RELATED ART
FIG. 1 is a cross-sectional view illustrating a relation of a moving member and a flexible seal in a related art configuration.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

Figure 2:
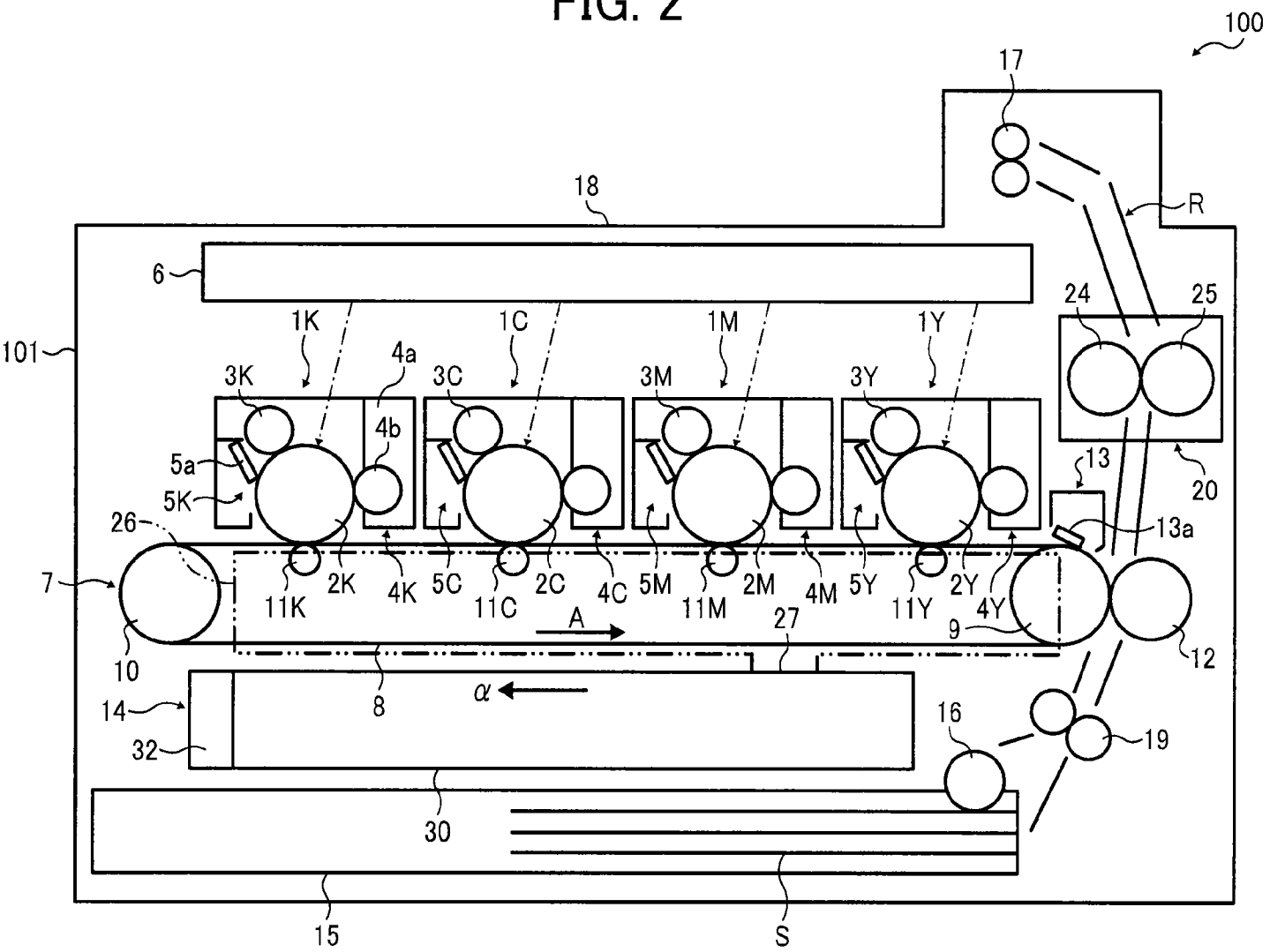
FIG. 2 is a cross-sectional view illustrating a schematic configuration of an image forming apparatus.

A description is given of a configuration and functions of an image forming apparatus 100 according to an embodiment of the present invention, with reference to FIG. 2.

The image forming apparatus 100 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 100 is an electrophotographic color printer that forms color and monochrome toner images on recording media by electrophotography.

As illustrated in FIG. 2, the image forming apparatus 100 includes units and components for image forming in a body 101. The body 101 contains four image forming units 1Y, 1M, 1C, and 1K at a center part thereof. The image forming units 1Y, 1M, 1C, and 1K form yellow (Y), magenta (M), cyan (C), and black (K) toner images, respectively, which correspond to respective color separation elements of color images. Except for the colors of toners, the image forming units 1Y, 1M, 1C, and 1K have configurations identical to each other.

Hereinafter, the units and components included in the body 101 of the image forming apparatus 100 are often referred to in a singular unit without suffix indicating toner colors. For example, the image forming units 1Y, 1M, 1C, and 1K may be referred to as "the image forming unit 1".

As illustrated in FIG. 2, the image forming unit 1 includes a photoconductor 2 (i.e., photoconductors 2K, 2C, 2M, and 2Y), a charging roller 3 (i.e., charging rollers 3K, 3C, 3M, and 3Y), a development unit 4 (i.e., development units 4K, 4C, 4M, and 4Y), and a photoconductor cleaning unit 5 (i.e., photoconductor cleaning units 5K, 5C, 5M, and 5Y).

The photoconductor 2 functions as an image carrier to carry an electrostatic image on a surface thereof.

The charging roller 3 functions as a charger to uniformly charge the surface of the photoconductor 2.

The development unit 4 supplies toner to the electrostatic latent image formed on the charged surface of the photoconductor 2 and develops the electrostatic latent image into a visible toner image.

The photoconductor cleaning unit 5 cleans the surface of the photoconductor 1.

Further, the image forming unit 1 is formed in a process cartridge that is detachably attachable to the body 101 of the image forming apparatus 100. The process cartridge integrally includes the photoconductor 2, the charging roller 3, the development unit 4, and the photoconductor cleaning unit 5.

The development unit 4 includes a toner hopper 4*a* to contain toner therein and a development roller 4*b*. The toner contained in the toner hopper 4*a* is supplied to a surface of the photoconductor 2 along with rotation of the development roller 4*b*. Polymerized toner having roundness in a range of from 0.96 to 0.98 is preferably used as toner of each color contained in the toner hopper 4*a*.

The photoconductor cleaning unit 5 cleans the surface of the photoconductor 2. The photoconductor cleaning unit 5 includes a cleaning blade 5*a* that contacts in a counter direction with respect to a rotational direction of the photoconductor 2

As illustrated in FIG. 2, the body 101 of the image forming apparatus 100 further includes an exposure unit 6 disposed above the image forming units 1Y, 1M, 1C, and 1K.

The exposure unit 6 included in the image forming apparatus 100 according to the present embodiment includes a light source, a polygon mirror, fθ (f-theta) lens, reflection mirrors, and so forth to function as an electrostatic latent image forming unit. The exposure unit 6 emits laser light to the surface of the photoconductor 2 based on image data so as to expose the charged surface of the photoconductor 2 to form an electrostatic latent image for a given single color toner image. Alternatively, the exposure unit 6 can include an LED (light emitting diode) array or LED arrays.

As illustrated in FIG. 2, the body 101 of the image forming apparatus 100 further includes a transfer unit 7 disposed below the image forming units 1Y, 1M, 1C, and 1K.

The transfer unit 7 transfers the toner image onto a paper P functioning as a recording medium. The transfer unit 7 includes an intermediate transfer belt 8 functioning as an endless transfer belt. The intermediate transfer belt 8 is spanned around a drive roller 9, a driven roller 10, and primary transfer rollers 11Y, 11M, 11C, and 11K in a loop. As the drive roller 9 rotates counterclockwise in FIG. 2, the intermediate transfer belt 8 rotates in a direction indicated by arrow A in FIG. 2.

The primary transfer roller 11 (i.e., the primary transfer rollers 11Y, 11M, 11C, and 11K) is disposed facing the photoconductor 2 with the intermediate transfer belt 8 interposed therebetween. Specifically, the primary transfer roller 11 presses against an inner circumferential surface of the intermediate transfer belt 8, thereby forming a primary transfer nip area where the pressed area of the intermediate transfer belt 8 and the photoconductor 2 contact each other. The primary transfer roller 11 is connected to a power supply from which a given direct current (DC) voltage and/or a given alternating current (AC) voltage are applied to the primary transfer roller 11. It is to be noted that the primary transfer roller 11 functioning as a primary transfer member in the present embodiment is a metallic roller. However, a conductive blade or a conductive sponge roller can be used instead of a metallic roller.

As illustrated in FIG. 2, the body 101 of the image forming apparatus 100 further includes a secondary transfer roller 12 disposed facing the drive roller 9.

The secondary transfer roller 12 functions as a secondary transfer member to press against the outer circumferential surface of the intermediate transfer belt 8. Where the pressed area of the intermediate transfer belt 8 and the secondary transfer roller 12 contact each other forms a secondary transfer nip area. Similar to the primary transfer roller 11, the secondary transfer roller 12 is connected to a power supply from which a given direct current (DC) voltage and/or a given alternating current (AC) voltage are applied to the secondary transfer roller 12. The secondary transfer roller 12 includes a metallic core covered by an elastic body of conductive material. As an example of the secondary transfer roller 12, a conductive roller, an electronically conductive roller or the like can be employed.

Further, as illustrated in FIG. 2, the body 101 of the image forming apparatus 100 includes a belt cleaning device 13 disposed on an outer circumferential surface of the intermediate transfer belt 8 at a position upstream from the image forming units 1Y, 1M, 1C, and 1K (on a loosened side of the intermediate transfer belt 8) in the direction A. The belt cleaning device 13 includes a cleaning blade 13*a* that contacts in a counter direction with respect to a moving direction of the intermediate transfer belt 8.

As illustrated in FIG. 2, the body 101 of the image forming apparatus 100 further includes a duct 26 and a toner collection unit 14 that includes a collected toner container 30. The duct 26 is disposed below the transfer unit 7 and the toner collection unit 14 is disposed below the duct 26.

The duct 26 functions as a toner conveying member and is connected to an inlet 27 provided to the collected toner container 30.

Toner or waste toner collected by the photoconductor cleaning device 5 and the belt cleaning device 13 is conveyed via the duct 26 and the inlet 27 and stored in the collected toner container 30 of the toner collection unit 14.

A sheet tray 15 and a feed roller 16 are disposed at a lower part of the body 101 of the image forming apparatus 100 in FIG. 2.

The sheet tray 15 accommodates a stack of sheets including a sheet S functioning as a recording medium.

The feed roller 16 feeds the sheet S from the sheet tray 15.

It is to be noted that the sheet S is not limited to indicate paper material but also includes thick paper, postcard, envelope, regular paper, coated paper, art paper, tracing paper and the like. Further, as a recording medium, a plastic material such as OHP sheet, OHP film and the like can be used.

The body 101 of the image forming apparatus 100 in FIG. 2 includes a sheet discharging roller pair 17 and a sheet discharging tray 18.

The sheet discharging roller pair 17 is disposed at an upper part of the body 101 to discharge the sheet S to an outside of the body 101.

The sheet discharging tray 18 is provided on top of an upper surface of the body 101 to stock the sheet S discharged outside by the sheet discharging roller pair 17.

A sheet pathway R is defined by the rollers and units disposed in the body 101 of the image forming apparatus 100 to convey the sheet S from the sheet tray 15 to the sheet discharging tray 18 via the secondary transfer nip area.

A registration roller pair 19 is disposed upstream from the secondary transfer roller 12 in a sheet conveying direction in the sheet pathway R. The registration roller pair 19 functions as a timing roller pair to convey the sheet S to the second transfer nip area by adjusting a timing to convey the sheet S with movement of the toner image formed on the surface of the intermediate transfer belt 8.

A fixing unit 20 is disposed downstream from the secondary transfer roller 12 in the sheet conveying direction. The fixing unit 20 fixes an unfixed toner image transferred onto the sheet S to the sheet S. The fixing unit 20 includes a fixing roller 24 that includes a heater and a pressure roller 25 that is pressed by the fixing roller 24. Where the fixing roller 24 and the pressure roller 25 contact each other forms a fixing nip area.

Next, a description is given of basic image forming operations of the image forming apparatus 100 according to an embodiment with reference to FIG. 2.

As shown in FIG. 2, a non-illustrated controller provided to the image forming apparatus 100 issues a signal to a non-illustrated drive unit drives to rotate the photoconductor 2 of the image forming unit 1 clockwise in FIG. 2. As the photoconductor 2 rotates, the charging roller 3 uniformly charges the surface of the photoconductor 2 to a given polarity. The exposure unit 6 emits laser light based on image data transmitted from a non-illustrated image reading device and/or the controller to irradiate the charged surface of the photoconductor 2. With this action, an electrostatic latent image is formed on the surface of the photoconductor 2. The image data exposed to the photoconductors 2Y, 2M, 2C, and 2K is single color image data produced by separating a full-color image into respective color data of yellow, magenta, cyan, and black. The development unit 4 develops the thus-created electrostatic image on the surface of the photoconductor 2 into a visible toner image by supplying toner.

As the image forming operation starts, the controller starts the intermediate transfer belt 8 to rotate in the direction A in FIG. 2. Further, a voltage controlled to have a constant voltage or a constant current is applied to the primary transfer roller 11 so as to be charged to a polarity opposite to a toner charge polarity. With this action, a transfer magnetic field is generated in the primary transfer nip area.

Thereafter, as the photoconductors 2Y, 2M, 2C, and 2K rotate, the respective toner images formed on the photoconductors 2Y, 2M, 2C, and 2K are conveyed toward the respective primary transfer nip areas. When the toner images reach the respective primary transfer nip areas, the respective toner images formed on the photoconductors 2Y, 2M, 2C, and 2K are sequentially overlaid each other and transferred onto the intermediate transfer belt 8 due to action of the transfer magnetic fields generated at the respective primary transfer nip areas. Accordingly, a full-color toner image is formed on the surface of the intermediate transfer belt 8. Residual toner that remains on the surface of the photoconductor 2 after transfer of the toner image onto the intermediate transfer belt 8 is removed by the cleaning blade 5*a* of the photoconductor cleaning unit 5 to clean the surface of the photoconductor 2. The residual toner removed from the surface of the photoconductor 2 is conveyed to the collected toner container 30 of the toner collection unit 14 via the duct 26.

Further, a non-illustrated electric discharging unit removes residual charge on the surface of the photoconductor 2. Consequently, the charge of the surface of the photoconductor 2 is initialized to be ready for a subsequent image forming operation.

Further, the controller also causes the feed roller 16 to rotate to feed the sheet S from the sheet tray 15 to the sheet pathway R. Conveyance of the sheet S fed in the sheet pathway R is controlled by the registration roller pair 19 before the sheet S reaches the secondary transfer nip area. At this time, the secondary transfer roller 12 is applied with a transfer voltage that has the polarity opposite to the toner charge polarity on the toner image formed on the intermediate transfer belt 8. With this application of the transfer voltage to the secondary transfer roller 12, a transfer magnetic field is formed in the secondary transfer nip area.

Thereafter, as the intermediate transfer belt 8 rotates, the toner image formed on the intermediate transfer belt 8 approaches the secondary transfer nip area. When the toner image reaches the secondary transfer nip area, the transfer magnetic field generated in the secondary transfer nip area causes the toner image on the intermediate transfer belt 8 to be transferred onto the sheet S.

Residual toner that remains on the surface of the intermediate transfer belt 8 after transfer of the toner image onto the sheet S is removed by the cleaning blade 13*a* of the belt cleaning unit 13 to clean the surface of the intermediate transfer belt 8. Similar to the residual toner removed from the surface of the photoconductor 2, the residual toner removed from the surface of the intermediate transfer belt 8 is conveyed to the collected toner container 30 of the toner collection unit 14 via the duct 26.

Thereafter, the sheet S is conveyed to the fixing unit 20. In the fixing unit 20, as the sheet S passes through the fixing nip area formed between the fixing roller 24 and the pressure roller 25, the toner image is fixed to the sheet S. Then, the sheet S is discharged by the sheet discharging roller pair 17 and is stack on the sheet discharging tray 18.

The above-described basic image forming operations are performed by the image forming apparatus 100 for forming a full-color image on the sheet S. However, a monochrome image can be formed by using one of the image forming units 1Y, 1M, 1C, and 1K. Alternatively, a two-color image or a three-color image can be formed by using two or three of the image forming units 1Y, 1M, 1C, and 1K.

Figure 3:
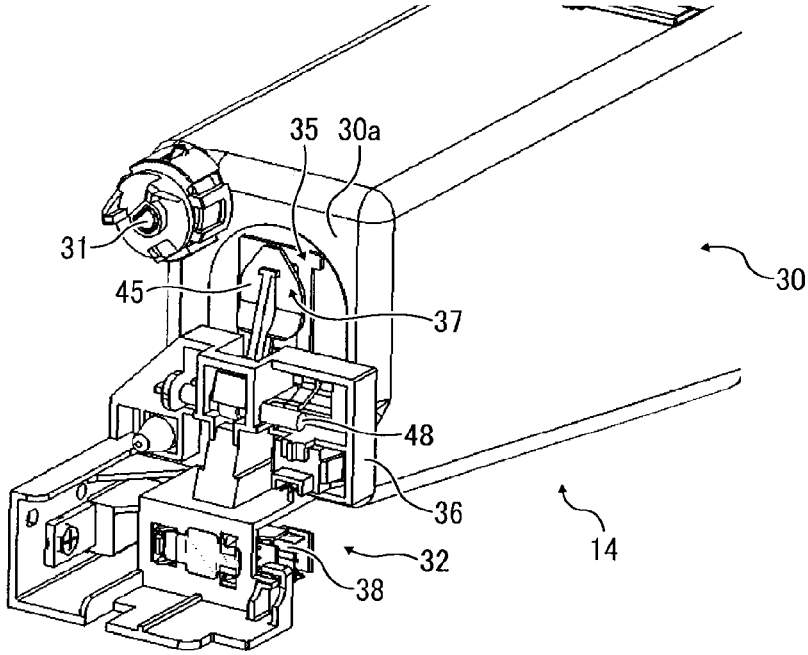
FIG. 3 is a perspective view illustrating one end side of a toner collection unit incorporated in the image forming apparatus of FIG. 2.
Figure 4:
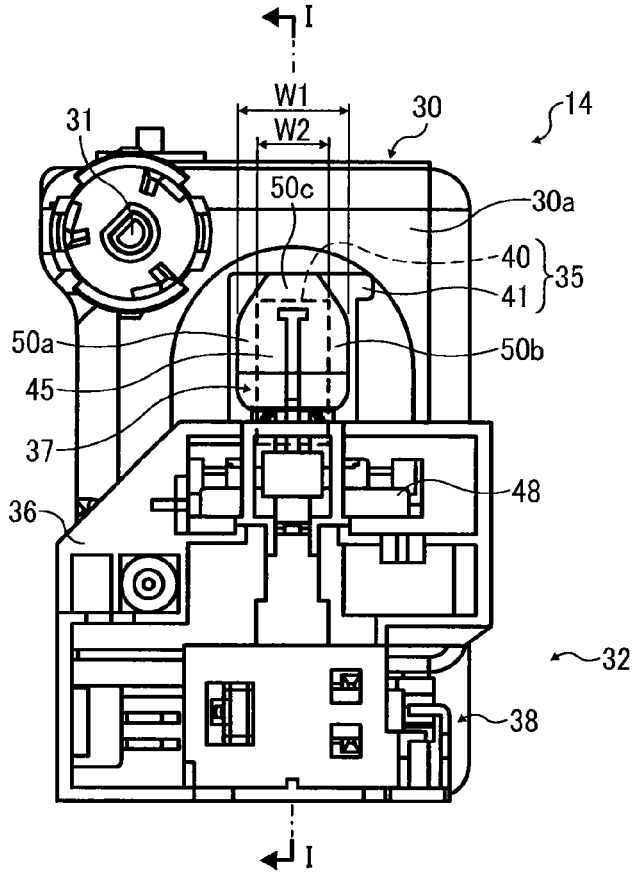
FIG. 4 is a front view illustrating the toner collection unit, viewing from the one end side.

A description is given of a configuration of the toner collection unit 14 with reference to FIGS. 3 and 4.

FIG. 3 is a perspective view illustrating a structure of one end side of the toner collection unit 14, and FIG. 4 is a front view of the toner collection unit 14 viewed from the one end side of the toner collection unit 14 illustrated in FIG. 3.

It is to be noted that this "one end side" indicates a downstream side of a conveying member 31 in a toner conveying direction indicated by arrow "α" in FIG. 2.

As illustrated in FIGS. 3 and 4, the toner collection unit 14 basically includes the collected toner container 30, the conveying member 31, and a toner full detection mechanism 32.

The toner full detection mechanism 32 is disposed at the one end side of the collected toner container 30 of the toner collection unit 14.

The collected toner container 30 is detachably attached to the body 101 of the image forming apparatus 100 in view of operability of disposal of waste toner when the waste toner stored in the collected toner container 30 reaches a toner full state.

The collected toner container 30 is a resin box that contains the waste toner collected by the photoconductor cleaning device 5 and the belt cleaning device 13. To increase charging efficiency of waste toner in the collected toner container 30, it is preferable that the collected toner container 30 has a sufficient height to accumulate the waste toner in a vertical direction thereof. However, the inside of the body 101 of the image forming apparatus 100 is a limited space, and therefore it is difficult to include the collected toner container 30 having the above-described size and structure to accumulate the waste toner vertically. To address this inconvenience, the collected toner container 30 employed in the present embodiment has a shape of cuboid or rectangular solid with a small length of each vertical lines. As illustrated in FIG. 2, the collected toner container 30 is arranged inside the body 101 of the image forming apparatus 100 with a longitudinal line thereof in a horizontal direction.

Figure 5:
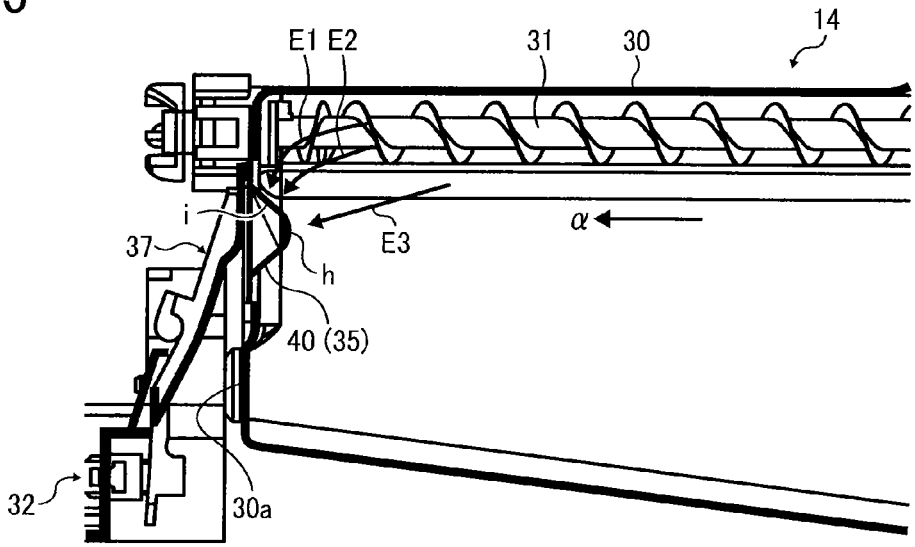
FIG. 5 is a cross-sectional view illustrating the one end side of the toner collection unit of FIG. 4 along a line I-I.

With reference to FIG. 5, a description is given of a configuration of the one end side of the toner collection unit 14.

FIG. 5 is a cross-sectional view of the one end side of the toner collection unit 14 along a line I-I of FIG. 4.

As illustrated in FIG. 5, the conveying member 31 is disposed along the longitudinal direction of the collected toner container 30 above the collected toner container 30. The conveying member 31 is rotatably supported by the collected toner container 30 at both ends in the longitudinal direction thereof and is driven to rotate by a drive source disposed in the body 101 of the image forming apparatus 100. Both ends of the whole conveying member 31 within the collected toner container 30 include a conveyance screw. Rotation of the conveyance screw agitates the waste toner stored in the collected toner container 30. At the same time, the waste toner entered from the inlet 27 (refer to FIG. 2) close to the sheet pathway R of the collected toner container 30 is conveyed in the horizontal direction and toward the one end side of the collected toner container 30 in the toner conveying direction α as shown in FIG. 5. As illustrated in FIG. 2, the toner conveying direction α is a direction in which the waste toner moves away from the sheet pathway R of the image forming apparatus 100.

As described above, the present embodiment uses polymerized toner having a circularity of from 0.96 to 0.98 to reduce a sliding load between toner particles of waste toner. Therefore, even if the collected toner container 30 of the present embodiment includes a single conveying member (i.e., the conveying member 31), waste toner can be uniformly stored in the collected toner container 30. It is to be noted that the collected toner container 30 can include multiple conveying members 31 (i.e., the conveying members 31) if required.

Figure 8:
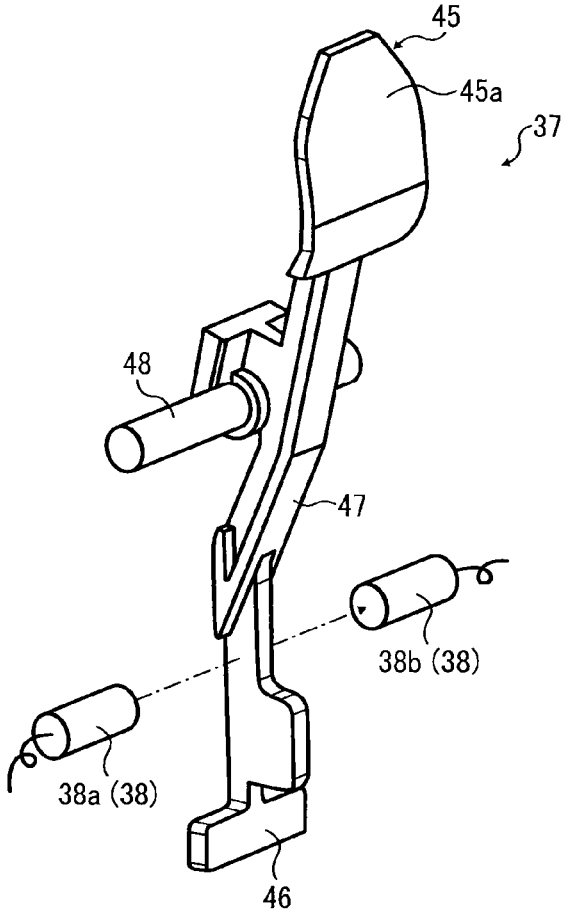
FIG. 8 is a perspective view illustrating a whole configuration of the moving unit.

As illustrated in FIG. 3, the toner full detection mechanism 32 that is disposed downstream from the conveying member 31 in the toner conveying direction α includes a seal member 35, a base member 36, a moving unit 37, and a detection unit 38. The base member 36 is a resin molding and is detachably attached to the body 101 of the image forming apparatus 100. One end of the collected toner container 30 is detachably attached to the base member 36. The detection unit 38 includes a light emitting element 38*a* and a light receiving element 38*b* (as illustrated in FIG. 8). Both the light emitting element 38*a* and the light receiving element 38*b* are attached to the base member 36. The base member 36 functions as a supporting member to pivotably support the moving unit 37. It is to be noted that the base member 36 may be provided integrally with the body 101 of the image forming apparatus 100 or with the collected toner container 30.

Figure 6:
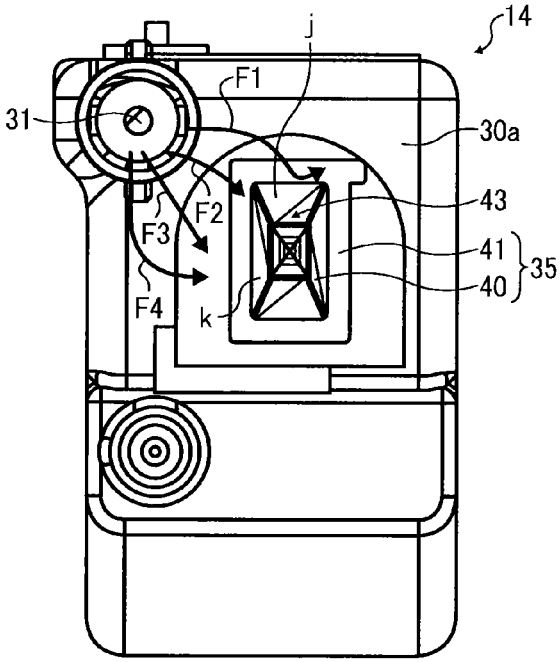
FIG. 6 is a front view illustrating the toner collection unit without a base portion, viewing from the one end side.

With reference to FIG. 6, a description is give of a configuration of the toner collection unit 14 detached from the base member 36.

FIG. 6 is a front view illustrating the toner collection unit 14 from the one end side after the base member 36 is removed therefrom.

As illustrated in FIG. 6, the seal member 35 according to the present embodiment is provided with a flexible seal 40 and a frame 41. The frame 41 is a rectangular frame to hold around the flexible seal 40. The flexible seal 40 includes soft material, e.g., rubber or resin, having a thickness of approximately 0.1 mm. By including such soft material, the flexible seal 40 has flexibility to change the shape thereof due to a pressing force exerted from the waste toner stored in the collected toner container 30. The frame 41 has rigidity to retain the shape of the seal member 35. As long as this rigidity of the frame 41 can be maintained, the frame 41 can be formed by optional material such as rubber, resin, or metal. It is preferable that the flexible seal 40 and the frame 41 are integrally formed by a method of insert molding or vulcanized adhesion.

Figure 7:
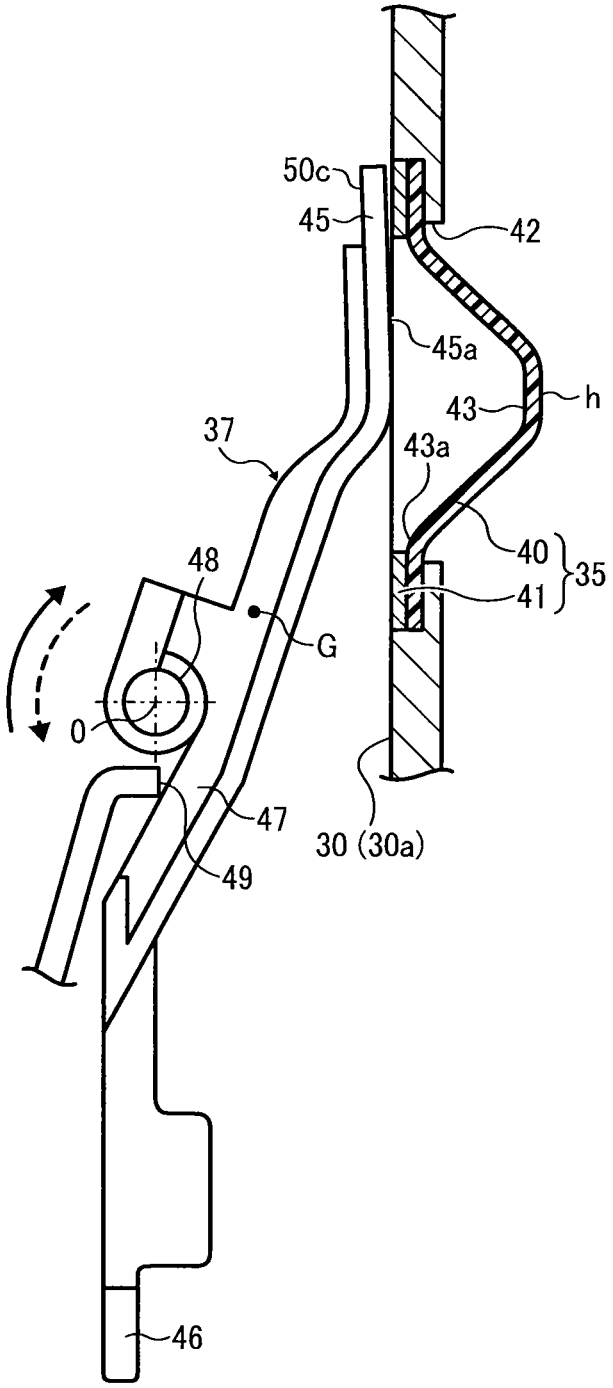
FIG. 7 is an enlarged cross-sectional view illustrating a moving unit and a seal member of FIG. 5.

With reference to FIGS. 7 and 8, a description is given of a configuration of the moving unit 37 and the seal member 35.

FIG. 7 is an enlarged cross-sectional view illustrating the moving unit 37 and the seal member 35 of FIG. 5. FIG. 8 is a perspective view illustrating a whole configuration of the moving unit 37.

The collected toner container 30 includes an end surface 30*a* at one end thereof. As illustrated in FIG. 7, an opening 42 is formed in the end surface 30*a*. The opening 42 has a rectangular shape, when seen from a planar view. The seal member 35 is provided outside the end surface 30*a* and is fixed to an adjacent area of the opening 42 by a suitable method such as adhesion. By so doing, the opening 42 of the collected toner container 30 is sealed by the seal member 35. Before waste toner is stored in the collected toner container 30, which is hereinafter referred to as an "initial condition", the flexible seal 40 has a cross-sectional recessed shape with a recessed portion 43 protruding inside the collected toner container 30 and stays in the opening 42. The shape of the recessed portion 43 of the flexible seal 40 is optionally selectable. In the present embodiment, the recessed portion 43 has a shape close to a truncated square pyramid as illustrated in FIG. 6.

As illustrated in FIGS. 7 and 8, the moving unit 37 has a long body as a whole and integrally includes a contact portion 45, a weight 46, a link portion 47, and a shaft 48.

The contact portion 45 is provided at one end (i.e., a top end in the present embodiment) of the moving unit 37. The weight 45 is provided at the other end (i.e., a bottom end in the present embodiment) in a longitudinal direction of the moving unit 37. The link portion 47 links the contact portion 45 and the weight 46. The shaft 48 extends in a direction perpendicular to a longitudinal direction of the link portion 47. The moving unit 37 is preferably a resin molding so as to make the moving unit 37 lighter in weight.

The shaft 48 of the moving unit 37 is rotatably supported by the base member 36 via a bearing or bearings. With this configuration, the moving unit 37 is rotatable about a rotation axis O that is the center of the shaft 48 in a positive direction indicated by a solid line in FIG. 7 to come close to the opening 42 and in an opposite direction indicated by a dashed line in FIG. 7 to move away from the opening 42.

The shaft 48 of the moving unit 37 is disposed at a position that is substantially in the middle between the one end (the top end) of the moving unit 37 and the other end (the bottom end) thereof and shifted away from the collected toner container 30 with respect to a straight line connecting both ends thereof. In this case, gravity G of the moving unit 37 is located at a position shifted from the rotation axis O toward the collected toner container 30. Therefore, rotational moment generated by the aid of gravity of the moving unit 37 in a positive direction (a direction indicated by a solid line) constantly acts on the moving unit 37.

According the above-described structure, the moving unit 37 is constantly biased in the positive direction of rotation. To position the moving unit 37 in the initial condition, the base member 36 has a stopper 49 to regulate rotation of the moving unit 37 in the positive direction, as illustrated in FIG. 7. Accordingly, with the moving unit 37 positioned by the stopper 49, the contact portion 45 of the moving unit 37 is lightly in contact with the frame 41 of the seal member 35 or is separated from the frame 41 with a gap. Hereinafter, a position where the moving unit 37 is located after being positioned by the stopper 49 is referred to as an "initial position".

As illustrated in FIG. 8, the contact portion 45 is a thin plate having a width greater than a width of the link portion 47. The contact portion 45 includes a contact surface 45*a* that is a flat surface without unevenness to contact the flexible seal 40.

As illustrated in FIG. 4, the contact portion 45 has a width W1 that is greater than a width W2 of the recessed portion 43 of the flexible seal 40 (indicated by a broken line) inside the frame 41 (W1>W2). Consequently, extended portions 50*a* and 50*b* that extend out of the recessed portion 43 of the flexible seal 40 are formed at vertical edges of both end sides of the contact portion 45 in FIG. 4. A tip of the contact portion 45 extends beyond an upper edge of the recessed portion 43 of the flexible seal 40. According to this structure, an extended portion 50*c* that extends out of the recessed portion 43 of the flexible seal 40 is formed at the tip of the contact portion 45. The extended portions 50*a* through 50*c* formed on the contact portion 45 function as regulators to regulate or prevent the contact portion 45 from coming into the recessed portion 43 of the flexible seal 40.

A detection unit 38 that functions as a detector is disposed in the vicinity of the moving unit 37 to detect movement of the moving unit 37. For example, as illustrated in FIG. 8, the detection unit 38 can be a photointerrupter including the light emitting element 38*a* and the light receiving element 38*b*. In this case, the light emitting element 38*a* and the light receiving element 38*b* are disposed facing each other in a direction in which the rotation axis O of the moving unit 37 extends (or the shaft 48 extends). At the same time, a part of the moving unit 37 at the initial position (e.g., the link portion 47) is disposed on a light pathway that runs between the light emitting element 38*a* and the light receiving element 38*b* so as to block the light pathway. By so doing, when the moving unit 37 moves from the initial position by an amount greater than a given amount, the moving unit 37 shifts out of the light pathway and the light receiving element 38*b* starts to receive the light emitted from the light emitting element 38*a*. According to a light receiving signal issued from the light receiving element 38*b*, the detection unit 38 can detect that the moving unit 37 moves by the amount greater than the given amount.

Now a description is given of functions of the toner collection unit 14.

As previously described, the flexible seal 40 in the initial condition has the cross-sectional recessed shape with the outward recessed portion 43 as illustrated in FIGS. 5 and 7. The waste toner collected from the photoconductor cleaning device 5 and the belt cleaning device 13 and conveyed to the collected toner container 30 is conveyed toward the one end side of the collected toner container 30 in accordance with rotation of the conveying member 31.

Figure 9:
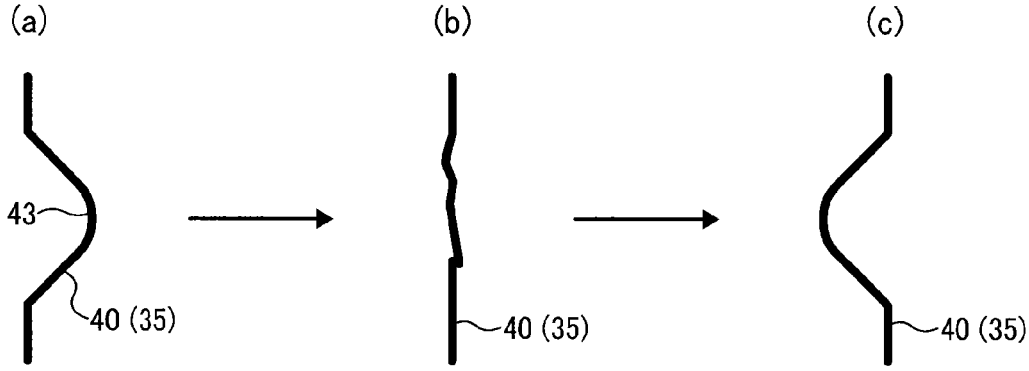
FIGS. 9(*a*) through 9(*c*) are cross-sectional views illustrating steps of how the shape of the seal member changes.

When the waste toner stored in the collected toner container 30 accumulates beyond a given amount for storage, the waste toner that is pushed to the one end side of the collected toner container 30 by the conveying member 31 receives a conveyance force of the conveying member 31 to exert a pressing force to the flexible seal 40. With this action, the flexible seal 40 starts to bulge outward as illustrated in FIG. 9(*a*). In the present embodiment, the flexible seal 40 is disposed at the end surface 30*a* of the collected toner container 30, which is a downstream side of the collected toner container 30 in the toner conveying direction α of the conveying member 31. Therefore, the conveyance force of the conveying member 31 is transmitted to the flexible seal 40 indirectly via the waste toner in the collected toner container 30. Accordingly, the flexible seal 40 can be bulged out smoothly.

As waste toner is accumulated in the collected toner container 30, the flexible seal 40 is bulged out to be flat as illustrated in FIG. 9(*b*), so that the flexible seal 40 contacts the contact portion 45 of the moving unit 37. As accumulation of the waste toner in the collected toner container 30 continues, the flexible seal 40 is further protruded outwardly to change to the cross-sectional recessed shape as illustrated in FIG. 9(*c*). At this time, the contact portion 45 is pressed by the flexible seal 40, so as to rotate the moving unit 37 in the opposite direction. When the flexible seal 40 is bulged outward to its limit, the moving unit 37 (i.e., the link portion 47 in the present embodiment) moves out of the light pathway. Consequently, the light receiving element 38*b* receives the light emitted from the light emitting element 38*a* and issues the light receiving signal. With this operation, the detection unit 38 detects that the waste toner stored in the collected toner container 30 approaches the toner full state, and a message reporting the detection result addressed to user is displayed on an operation panel of the image forming apparatus 100.

While the conveying member 31 is rotating, the waste toner flows in the collected toner container 30 in respective directions indicated by arrows E1 through E3 in FIG. 5 and in respective directions indicated by arrows F1 through F4. In response to the flows of the waste toner, the flexible seal 40 in the initial condition usually starts to be bulged out from an area adjacent to the conveying member 31.

By contrast, the directions of flow of waste toner depend on a state of accumulation of the waste toner in the collected toner container 30. Therefore, a dominant flow cannot be primarily determined among the waste toner flows in the directions E1 through E3 and F1 through F4. Since the flexible seal 40 of the present embodiment is located in an obliquely downward direction of the conveying member 31, the flexible seal 40 starts to inflate from either one of a region including a top portion "h" and a region including a bottom portion "i" of the recessed portion 43 having a truncated square pyramid shape in FIG. 5. Further, the flexible seal 40 starts to inflate from either one of an upper side region including a slope "j" or a vertical side region (close to the conveying member 31) including a slope "k" of the recessed portion 43 having the truncated square pyramid shape in FIG. 6.

Thus, the flexible seal 40 is bulged out irregularly and unstably, and therefore it is difficult to predict the inflation of the flexible seal 40 correctly. Therefore, similar to FIG. 1 of the related art configuration, if the contact portion 45 is in the recessed portion 43 of the flexible seal 40 from the initial condition of the seal member 35, irregular inflation of the flexible seal 40 causes the contact portion 45 to be caught by the flexible seal 40. With this action, rotation of the moving unit 37 in the opposite direction is disturbed. As a result, it is likely that a time to detect the toner full state of the collected toner container 30 delays.

Different from the above-described configuration similar to that illustrated in FIG. 1, the configuration according to the present embodiment includes the extended portions 50*a* through 50*c* functioning as the regulators on the contact portion 45 of the moving unit 37. Therefore, the contact portion 45 can be logically prevented from entering into the recessed portion 43 of the flexible seal 40 (closer to the top portion "h" than a rising portion 43*a* of the recessed portion 43 in FIG. 6) in the initial condition. In this case, the flexible seal 40 contacts the contact portion 45 after inflation of the flexible seal 40 becomes stable, and therefore the chances that the flexible seal 40 is caught by the contact portion 45 decreases. Along with the flexible seal 40 being bulged out to change the shape, the moving unit 37 can be rotated in the opposite direction smoothly. Accordingly, the detection time of the toner full state of the collected toner container 30 can achieve higher precision, thereby preventing leakage of waste toner.

In the present embodiment, the contact portion 45 includes the contact surface 45*a* having the flat surface without irregularity, thereby preventing the flexible seal 40 from being caught further with respect to the contact portion 45.

In the present embodiment, the stopper 49 determines the initial position of the moving unit 37 to prevent that the contact portion 45 comes into the recessed portion 43 of the flexible seal 40. Accordingly, in the configuration of the present embodiment, not only the extended portions 50*a* through 50*c* of the contact portion 45 but also the stopper 49 function as regulators to regulate or prevent the contact portion 45 coming into the recessed portion 43. In this case, the regulators are provided to both the moving unit 37 and a supporting member (i.e., the base member 36) that supports the moving unit 37. For example, assuming the width W1 of the contact portion 45 is smaller than the width W2 of the recessed portion 43 of the flexible seal 40 inside the frame 41 (W1<W2), even when the stopper 49 is not provided to the base member 36, the extended portions 50*a* through 50*c* function as the regulators to prevent the contact portion 45 entering the recessed portion 43. By contrast, even when the extended portions 50*a* through 50*c* are not provided to the contact portion 45, the stopper 49 functions as the regulator to prevent the contact portion 45 coming into the recessed portion 43. According to the regulation of entrance of the contact portion 45 to the recessed portion 43 by the extended portions 50*a* through 50*c* and/or the stopper 49, the above-described effect can be achieved.

The extended portions 50*a* through 50*c* of the contact portion 45 may not need to be provided sequentially along each line of the contact portion 45. That is, the extended portions 50*a* through 50*c* may be provided in a partial region of each line of the contact portion 45. In this case, the extended portions 50*a* through 50*c* are in a form of an arm projecting from the contact portion 45. Further, there are three extended portions corresponding to the number of the extended portions 50*a* through 50*c* in the present embodiment. However, the number of extended portions is not limited thereto. For example, the contact portion 45 can have one, two, four or more extended portions.

Further, if the contact portion 45 includes the extended portions 50*a* through 50*c* as described in the present embodiment, no gap is formed between an edge of the contact portion 45 and an inner surface of the opening 42 of the collected toner container 30 (see FIG. 7). Therefore, when the flexible seal 40 starts to bulge out from the initial condition, even if the flexible seal 40 is changed into any shape, it can be prevented that a part of the flexible seal 40 enters into the gap so that the flexible seal 40 is caught by the contact portion 45 (see FIG. 13). Accordingly, an increase in transfer resistance of the moving unit 37 due to the flexible seal 40 being caught by the contact portion 45 can be avoided. As a result, a delay in detecting the toner full detection can be prevented reliably.

Figure 10:
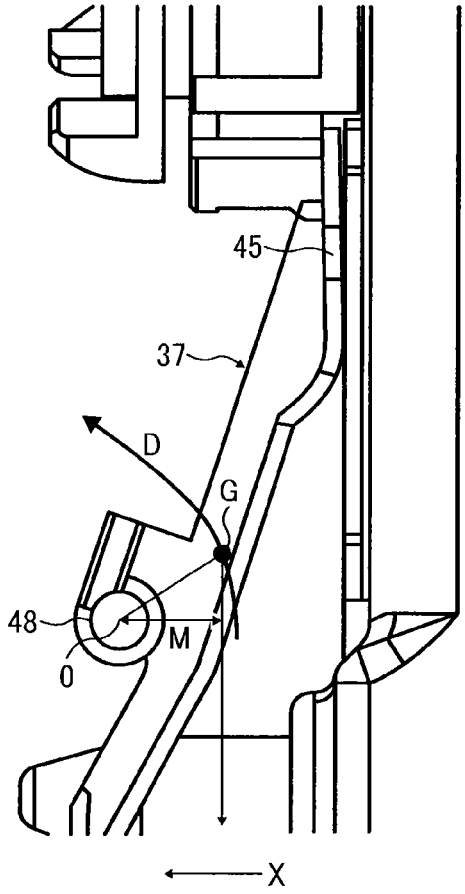
FIG. 10 is an enlarged cross-sectional view illustrating the moving unit of FIG. 5.
Figure 11:
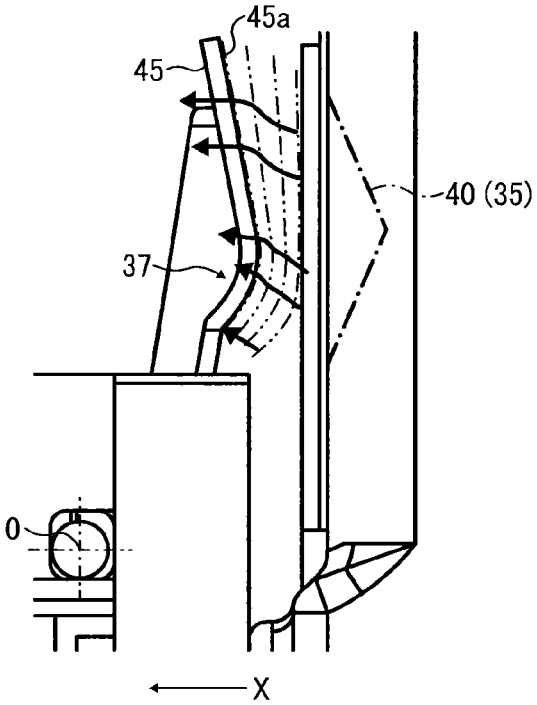
FIG. 11 is an enlarged cross-sectional view illustrating the moving unit of FIG. 5.

With reference to FIGS. 10 and 11, a description is given of the configuration and functions of the moving unit 37. Even though the seal member 35 is not illustrated in FIG. 10, a direction indicated by arrow "X" represents a seal inflation direction of the flexible seal 40 of the seal member 35.

As illustrated in FIG. 10, a curved line D represents a locus of center of gravity of the moving unit 37 when the moving unit 37 is rotated in the opposite direction. Focusing on a distance M between a line extending from the gravity G in a gravity direction and the rotation center O, as the moving unit 37 of the present embodiment rotates in the opposite direction, the distance M becomes shorter or smaller. It means that the moment of rotation or torque of the moving unit 37 in the positive direction acting on the moving unit 37 becomes smaller as the rotation of the moving unit 37 approaches to the end in the opposite direction.

While the flexible seal 40 is changing the shape from the cross-sectional recessed shape as illustrated in FIG. 9(*a*) (a drawing on the left) to the flat shape as illustrated in FIG. 9(*b*), as the inflated area of cross section of the flexible seal 40 increases, the load that the flexible seal 40 receives from the waste toner increases. By contrast, while the flexible seal 40 is bulging out from the flat shape as illustrated in FIG. 9(*b*) (a drawing at the center) to a cross-sectional protruding shape as illustrated in FIG. 9(*c*) (a drawing on the right), as the amount of inflation of the cross sectional area of the flexible seal 40 increases, a contact area of the flexible seal 40 and the contact portion 45 of the moving unit 37 decreases. Therefore, the load (pressure) acting on the contact portion 45 via the flexible seal 40 decreases as the amount of bulging out the flexible seal 40 increases.

As described above, the shape of the moving unit 37 in this case is designed such that the moment of rotation acting on the moving unit 37 decreases as the rotation of the moving unit 37 in the opposite direction approaches to the end. By so doing, the moving unit 37 is rotated in the opposite direction smoothly along with inflation of the flexible seal 40. Accordingly, a delay in detecting the toner full state of the collected toner container 30 can be prevented more reliably.

As illustrated by two-dot chain lines in FIG. 11, the position of the contact surface 45*a* of the contact portion 45 changes when the moving unit 37 rotates in the opposite direction. Also, arrows provided adjacent to the moving unit 37 indicate the movement loci of different regions on the contact surface 45*a* drawn while the moving unit 37 is rotating in the opposite direction. Since the movement loci of the regions on the contact surface 45*a* are substantially identical to the seal inflation direction X of the flexible seal 40, the contact surface 45*a* in rotation in the opposite direction does not slidably contact the flexible seal 40. Therefore, a friction force generated between the contact surface 45*a* and the flexible seal 40 does not hinder or stop rotation of the moving unit 37 in the opposite direction. As a result, the delay in detecting the toner full state of the collected toner container 30 can be prevented more reliably.

Figure 12:
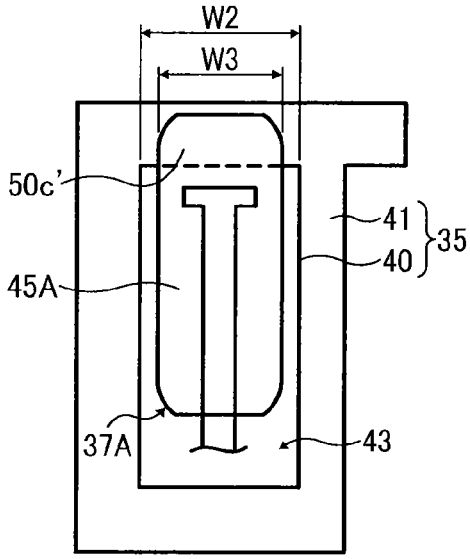
FIG. 12 is a front view illustrating a contact portion of a moving unit according to another embodiment, viewing a toner collection unit from one end side thereof.

With reference to FIG. 12, a description is given of a configuration of a moving unit according to another embodiment.

Different from the moving unit 37 illustrated in FIG. 4 that has a structure in which the extended portions 50*a* through 50*c* are provided at both ends and top end of the contact portion 45 thereof, a moving unit 37A illustrated in FIG. 12 has an extended portion 50*c*' that extends out of the recessed portion 43 of the flexible seal 40 from the top end of a contact portion 45A. A width W3 of the contact portion 45A is smaller than the width W2 of the recessed portion 43 of the flexible seal 40 (W3<W2).

With this configuration, the extended portion 50*c*' functions as a regulator that regulates or prevents the contact portion 45A from entering into the recessed portion 43 of the flexible seal 40. With the contact portion 45A having this configuration, the moving unit 37A can be lighter and more compact than the moving unit 37 illustrated in FIG. 4.

It is to be noted that an extended portion may be provided at the top end of the contact portion 45 as illustrated in FIG. 12. Alternatively, extended portions may be provided at both lateral ends of the contact portion 45 or an extended portion may be provided at either one of both lateral ends of the contact portion 45.

Figure 13:
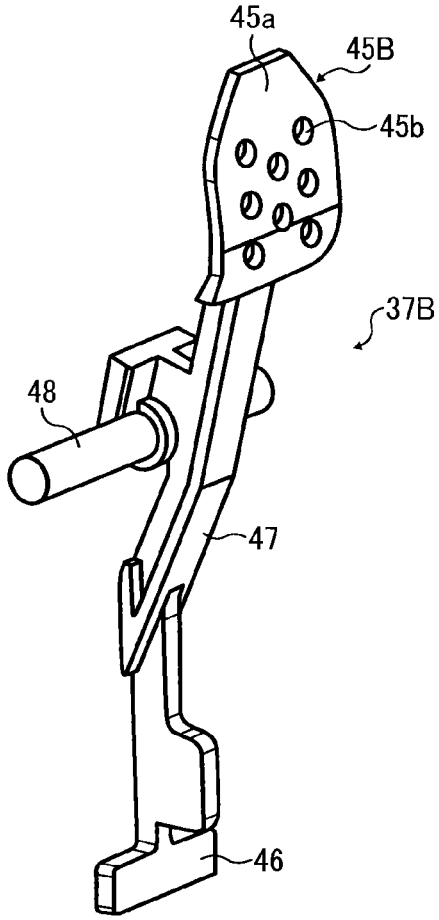
FIG. 13 is a perspective view illustrating a moving unit according to yet another embodiment.

With reference to FIG. 13, a description is given of a configuration of a moving unit according to yet another embodiment.

As illustrated in FIG. 8, if the contact portion 45 of the moving unit 37 is increased in size, the moment of rotation of the moving unit 37 increases. This can delay detection of the toner full state of the collected toner container 30. By contrast, as illustrated in FIG. 13, a moving unit 37B includes a contact portion 45B provided with multiple openings 45*b*. With this configuration of the moving unit 45B, the moving unit 37B can achieve a decrease in weight, thereby reducing the moment of rotation of the moving unit 37B. Accordingly, the delay in detecting the toner full state of the collected toner container 30 can be prevented.

By contrast, if the diameter of each of the openings 45*b* is too large, the flexible seal 40 may enter into the openings 45*b*. This increases the sliding load to cause a delay in detecting the toner full state of the collected toner container 30. To prevent the delay of the detection, it is preferable to reduce the diameter of each of the openings 45*b*, so as to prevent the flexible seal 40 coming into the opening 45*b*. For example, if the diameter of each of the openings 45*b* is 2.0 mm or smaller, the flexible seal 40 cannot enter into the opening 45*b* reliably.

It is to be noted that the present invention is not limited to the above-described embodiments and it will be obvious to those skilled in the art that various changes may be made without departing from the scope of the invention. For example, the image forming apparatus 100 that includes the toner collection unit 14 according to the above-described embodiments is a printer. However, the image forming apparatus 100 can be a copier, a facsimile machine, a multifunction peripheral or a multifunction printer (MFP) having at least one of copying, printing, scanning, facsimile, and plotter functions, or the like.

In the above-described embodiments, the flexible seal 40 is provided on the wall (an end surface) 30*a* located at the downstream side of the collected toner container 30 in the toner conveying direction $\alpha$ of the waste toner stored in the collected toner container 30 conveyed by the conveying member 31. However, the position of the flexible seal 40 is not limited thereto. Therefore, the flexible seal 40 can be provided on other surface (e.g., an upper surface, a lower surface) of the collected toner container 30 regardless of the toner conveying direction $\alpha$.

Further, the above-described embodiments show the configuration that the conveyance force of the conveying member 31 pressing the waste toner to bulge out the flexible seal 40. However, the present invention is not limited thereto. For example, the present invention applies a configuration in which the flexible seal 40 is bulged out by the aid of gravity of the waste toner without using the conveying member 31.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A toner collection unit comprising:

a collected toner container having an opening and storing collected toner;

a flexible seal to seal the opening of the collected toner container, the flexible seal having a shape of a cross-sectional recess in an initial condition before the toner is collected in the collected toner container and being flexible to change the shape to inflate outwardly due to a pressing force exerted from the toner stored in the collected toner container;

a moving unit disposed outside the flexible seal, movable both in a positive direction to approach the opening of the collected toner container and in an opposite direction to move away from the opening of the collected toner container, the moving unit configured to rotate in the opposite direction when contacting the flexible seal inflating outwardly;

a detector to detect movement of the moving unit; and a regulator to prevent the moving unit from entering the opening of the collected toner container and coming into contact with the recess of the flexible seal in the initial condition.

2. The toner collection unit according to claim 1, further comprising a supporting member to support the moving unit, wherein the regulator is disposed to the moving unit.

3. The toner collection unit according to claim 1, further comprising a supporting member to support the moving unit, wherein the regulator is disposed to the supporting member.

4. The toner collection unit according to claim 1, wherein the moving unit includes an extended portion extending out of a region of the recess of the flexible seal in the initial condition, wherein the extended portion functions as the regulator.

5. The toner collection unit according to claim 1, wherein the moving unit is rotatably supported, wherein the moving unit is formed to have rotational moment to become smaller as the moving unit rotates in the opposite direction.

6. The toner collection unit according to claim 1, further comprising a conveying member to convey the toner stored in the collected toner container, wherein the flexible seal is provided on a side wall of a downstream side in a direction in which the conveying member conveys the toner in the collected toner container.

7. The toner collection unit according to claim 1, wherein the moving unit includes a contact surface that is a flat surface without unevenness to contact the flexible seal.

8. The toner collection unit according to claim 7, wherein the contact surface is provided with multiple holes thereon.

9. The toner collection unit according to claim 1, wherein the toner uses a polymerized toner having roundness in a range of from 0.96 to 0.98.

10. An image forming apparatus comprising:

an image forming unit to form an image; and the toner collection unit according to claim 1.

11. An image forming apparatus comprising:

a collected toner container having an opening;

a flexible seal to seal the opening and including a recessed portion, the recessed portion being inflatable outwardly;

a contact plate including an extended portion that extends out of the recessed portion; and a detector to detect movement of the contact plate, wherein the extended portion is free of contact with the recessed portion and contacts with the collected toner container at an adjacent area of the opening when the recessed portion recesses, and the contact plate moves outwardly when the recessed portion inflates outwardly.

12. The image forming apparatus according to claim 11, further comprising a frame to hold the flexible seal.

13. The image forming apparatus according to claim 12, wherein the extended portion contacts with the frame.

14. The image forming apparatus according to claim 11, wherein the contact plate includes a contact surface that is a flat surface without unevenness to contact the flexible seal.

15. The image forming apparatus according to claim 14, wherein the extended portion extends from the contact surface.

16. The image forming apparatus according to claim 11, the collected toner container is detachably attached to the image forming apparatus.

17. The image forming apparatus according to claim 11, wherein the contact plate rotates about a rotation axis.

18. The image forming apparatus according to claim 11, wherein the contact plate is constantly biased toward the recessed portion.

19. An image forming apparatus comprising:

a collected toner container having an opening;

a flexible seal to seal the opening and including a recessed portion, the recessed portion being inflatable outwardly;

a contact plate to contact with the recessed portion and to move by inflation of the recessed portion; and a detector to detect movement of the contact plate, wherein a width of the contact plate is greater than a width of the opening so that the contact plate contacts the recessed portion only when the recessed portion is inflated outwardly.

20. The image forming apparatus according the claim 1, wherein the moving unit includes a contact portion at a first end in a longitudinal direction of the moving unit, a weight at second end in the longitudinal direction of the moving unit, a link portion which links the contact portion and the weight, and a shaft extending in a direction perpendicular to the longitudinal direction of moving unit.

* * * * *